US006601422B2

(12) United States Patent
Hartmann et al.

(10) Patent No.: US 6,601,422 B2
(45) Date of Patent: Aug. 5, 2003

(54) METHOD OF OPERATING A ROLLING TRAIN AND A CONTROL SYSTEM FOR A ROLLING TRAIN

(75) Inventors: Ralf Hartmann, Düsseldorf (DE); Detlef Breunung, Hilden (DE); Otmar Palzer, Jüchen (DE); Hans-Jürgen Reismann, Düsseldorf (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/073,816

(22) Filed: Feb. 11, 2002

(65) Prior Publication Data

US 2002/0112514 A1 Aug. 22, 2002

(30) Foreign Application Priority Data

Feb. 13, 2001 (DE) ..... 101 06 527

(51) Int. Cl.[7] ..... B21B 37/68

(52) U.S. Cl. ..... 72/7.6; 72/8.9; 72/11.6; 700/150

(58) Field of Search ..... 72/7.1, 7.2, 7.4, 72/7.6, 8.3, 8.9, 9.2, 11.1, 11.2, 11.6, 11.8, 12.7; 700/149, 150, 154, 155; 706/19, 21, 23, 25

(56) References Cited

U.S. PATENT DOCUMENTS

| | | | | |
|---|---|---|---|---|
| 3,694,636 A | * | 9/1972 | Smith, Jr. | 700/149 |
| 5,000,020 A | * | 3/1991 | Rohde et al. | 72/10.6 |
| 5,513,097 A | * | 4/1996 | Gramckow et al. | 700/48 |
| 5,553,475 A | * | 9/1996 | Hayashi et al. | 72/225 |
| 5,901,592 A | * | 5/1999 | Okamura | 72/10.4 |
| 6,098,060 A | * | 8/2000 | Yuan et al. | 706/26 |

* cited by examiner

*Primary Examiner*—Ed Tolan
(74) *Attorney, Agent, or Firm*—Herbert Dubno

(57) ABSTRACT

A rolling train for structural shapes in which at least on one side of a train having a plurality of mill stands, e.g. universal mill stands, a detector is provided for the actual profile of the rolled product. The actual profile is compared with a setpoint profile and corrected setpoint values for the operating parameters of the individual stands are generated for a corrected subsequent rolling operation or even the same rolling operation, appropriately weighted for the contribution of the various stands to the rolling effect.

12 Claims, 3 Drawing Sheets

METHOD OF OPERATING A ROLLING TRAIN AND A CONTROL SYSTEM FOR A ROLLING TRAIN

FIELD OF THE INVENTION

Our present invention relates to a method of operating a rolling train, especially for the production of structural shapes. The invention also relates to a rolling method, to a control system for a rolling line or train and to a rolling train provided with that control system. Specifically the invention deals with the rolling in a succession of mill stands, of an elongated workpiece to produce a structural shape, also referred to as a profiled product.

BACKGROUND OF THE INVENTION

In the production of structural shapes, rolling mill stands may be grouped together or arrayed in a rolling train and the elongated workpiece is passed in succession through these mill stands to reduce the cross section of the workpiece from stand to stand and thereby impart a particular configuration or profile to that workpiece in producing the rolled product. The rolled product may be composed of steel and the number of roll stands and the configurations of the rolls therein may vary depending upon the product produced and the size of the product.

Each roll stand is operated with a number of operating parameters which can include temperatures, speeds, rolling forces and, of course, such parameters as gap width and roll position, all of which or some of which may be controlled by effectors, for example, servomotors which may be fluid-operated or servovalves. The operating parameters can be adjusted in accordance with a setpoint value and it is known to provide the rolling stands with controls for supplying the setpoint values for a variety of such operating parameters.

The generally elongated workpiece is passed through the succession of mill stands in a rolling direction and a number of mill stands thus are disposed in succession in this direction so that the rolls of this mill stand can engage the workpiece in succession or one after the other and either at the same time or after the workpiece has left a preceding mill stand and entered a succeeding mill stand. The workpieces can be shaped in a single pass through the rolling mill train or in multiple passes.

A rolling train having a multiplicity of such stands is commonly used for the shaping of profiled rolled products or structural shapes and the profiled rolled product can be a so-called "heavy profile" with a U cross section or a double-T cross section or I-beam or H-beam cross sections. These cross sections have a web, usually the base of the channel for U-shaped cross sections and the central member of the H-beam or I-beam, and flanges which extend perpendicularly to one or both sides of the web.

In the shaping of such profiled workpieces in rolling mills, so-called universal mills are used at least in part. A universal mill comprises generally two horizontal rolls which are paired to roll the web of the structural shape and have a gap between them which is adjustable and determines the web thickness and a pair of vertical rolls which engage the opposite sides of the workpiece and determine the overall width of the structural shape produced.

These vertical rolls are usually disposed within the universal stand and can be located somewhat offset from the pairs of horizontal rolls.

In the operation of rolling lines with such mill stands, especially universal mills, each mill stand is supplied with setpoint values for a number of its operating parameters which are selected so that the product, upon rolling in that mill, will approach the setpoint profile of the desired product as closely as possible. These setpoint values adjust the mill, therefore, for the web thickness, the flange thickness, the rolled product width and like dimensions of the finished product. The setpoint values may be, for example, hydraulic pressures for the hydraulic controllers of roll positions or for the desired rolling forces.

In modern rolling trains, it is not uncommon to utilize derivative and comparatively complex operating parameters rather than simple parameters like roll positions, these more complex parameters taking into consideration factors such as temperature, gap cross sections and the like.

In any case it is important that the setpoint parameters which are applied to a particular mill stand be capable of producing a rolled product which is comparatively close in profile to the desired shape with dimensions within a limited tolerance range. However it is difficult to maintain comparatively narrow tolerances since during the rolling operation itself, various influences on such parameters arise and change in a relatively uncontrollable manner. As a consequence it is necessary to carefully monitor the rolling process and most commonly the operators are required to vary practically continuously the operating parameters applied to the mills during the rolling of a given workpiece or a series of such workpieces or even from workpiece to workpiece. In spite of these efforts, however, a high degree of precision and practically narrow tolerances cannot be satisfactorily maintained or can only be maintained with considerable expenditure of effort or with especially extensive equipment.

OBJECTS OF THE INVENTION

It is, therefore, the principal object of the present invention to provide an improved method of operating a rolling train of the above-described type and particularly for the production of structural shapes and especially heavy structural shapes such as channel, double-T girders, H-beams and I-beams, whereby drawbacks of earlier systems are avoided.

It is a particular object of the invention to provide a method of controlling a rolling train for such purposes whereby a comparatively low capital and operating cost, it is possible to obtain especially narrow tolerances in the production of profiled rolled products, i.e. structural shapes.

Another object is to provide a control system for a rolling mill train which allows narrow tolerances which establish and hold more reliably than with earlier systems.

A further object of this invention is to provide a rolling mill train for the rolling of structural shapes whereby drawbacks of earlier systems are avoided.

SUMMARY OF THE INVENTION

These objects and others which will become apparent hereinafter are attained, in accordance with the invention, in a method of operating a rolling mill train for producing structural shapes, especially heavy structural shapes or profiled products which comprises the steps of:

(a) rolling a workpiece in a succession of mill stands, each equipped with a plurality of working rolls engaging the workpiece to reduce a cross section thereof in a configuration of a structural shape to be produced, each of the mill stands having a plurality of adjustable operating parameters determining the rolling process in the respective mill stand;

(b) detecting a profile of a structural shape produced by the succession of mill stands and comparing the detected profile with a set-point profile corresponding to a structural shape to be produced;

(c) deriving from the comparison of the detected profile with the setpoint profile respective corrective setpoint values for each of the parameters determined by deviation of the detected profile from the setpoint profile;

(d) weighting each of the corrective setpoint values with a weighting factor specific to the respective mill stand to produce weighted corrected setpoint values for each of the parameters; and (e) adjusting the operating parameters of each of the mill stands with the respective weighted corrected setpoint values.

According to the invention the corrected setpoint values for at least one of the mill stands include a setpoint value for at least one structural shape dimensional parameters selected from a web thickness, a flange height and a flange thickness.

The corrected setpoint values can include setpoint values for each of the key structural shaped dimensional parameters, namely, flange height, flange thickness and web thickness.

According to another feature of the invention each of the mill stands is controlled individually by respective determinations of deviations of detected profiles from setpoint profiles for the respective mill stands, derivation of respective corrective setpoint values, weighting of the corrective setpoint values with respective mill-stand-specific weighting factors, and adjustment of the operating parameters of each individual mill stand with the respective weighted corrected setpoint values.

The rolling mill train according to the invention can comprise:

a succession of mill stands, each equipped with a plurality of working rolls engaging a workpiece to be rolled in the stands to reduce a cross section thereof in a configuration of a structural shape to be produced, each of the mill stands having a plurality of adjustable operating parameters determining the rolling process in the respective mill stand;

at least one sensor for detecting a profile of a structural shape produced by the succession of mill stands and comparing the detected profile with a set-point profile corresponding to a structural shape to be produced;

means for deriving from the comparison of the detected profile with the setpoint profile respective corrective setpoint values for each of the parameters determined by deviation of the detected profile from the setpoint profile and for weighting each of the corrective setpoint values with a weighting factor specific to the respective mill stand to produce weighted corrected setpoint values for each of the parameters; and means for adjusting the operating parameters of each of the mill stands with the respective weighted corrected setpoint values.

The control system for the purposes of the invention can comprise at least one sensor for detecting a profile of a structural shape produced by the succession of mill stands and comparing the detected profile with a setpoint profile corresponding to a structural shape to be produced, a computer connected to the sensor for comparing the detected profile with the setpoint profile and deriving respective corrective setpoint values for each of the parameters determined by deviation of the detected profile from the setpoint profile, means for weighting each of the corrective setpoint values with a weighting factor specific to the respective mill stand to produce weighted corrected setpoint values for each of the parameters, and means for adjusting the operating parameters of each of the mill stands with the respective weighted corrected setpoint values.

According to the invention, therefore, the profile of the rolled product emerging from the rolling train is detected and compared with a setpoint profile and one or more setpoints of one or more rolling mill stands is corrected based upon the deviation of the detected profile from the setpoint profile and is weighted by a mill-stand-specific weighting factor to serve as the weighted corrected setpoint which is applied to the effector of that mill stand for control purposes.

The setpoint profile may be contained in memory of a computer serving for the comparison and weighting factors may also be in electronic storage. The computer can generate, therefore, not only the corrected parameter value but also the weighted corrected value as a function of the stored information.

The invention is based upon the concept that it is possible to maintain especially narrow tolerances with respect to the profile of the rolled product when this profile is continuously monitored and evaluated as soon as possible after being imparted to the workpiece and directly upon rolling, especially during the ongoing rolling process. In that case, deviations of the actual produced profile from the predetermined setpoint profile can be detected during the production of the rolled product and these deviations can be utilized to generate appropriate corrective values to compensate for the setpoint value. The correction value can be supplied as an additional setpoint value and can be utilized in control as soon as appropriate measured values for the actual profile are obtained. The generation of the additional setpoint values, i.e. the corrected setpoint values, can be length synchronized, i.e. can be synchronized with the length of the workpiece as it is being rolled so that corrections can be made for corresponding portions of the length. Alternatively, or in addition, they may be time synchronized so that the adjustments of the mill stands are made for corresponding points in time during the rolling process.

Especially high precision can be obtained if the corrected setpoint values are applied to effect correction at as close as possible to the location in which the deviation from the setpoint profile arises.

The tolerance-existing deviations in the profile of the rolled product which is produced may stem from a number of sources, namely, from each of the mill stands traversed by the rolled product and can be cumulative in the product leaving the rolling trains. Such cumulative deviations are readily ascertained by comparing the actual profile with the setpoint profile and require a single and simple measurement system. However, the corrections must be distributed to the individual mill stands at which the errors arise and this is achieved, in accordance with the invention by providing mill-stand-specific weighting factors for the corrected setpoint values which are fed back to the mill stands. These weighting factors, representing the contribution of each mill stand to a potential defect can be varied during the course of rolling based upon the measurements made and thus represent a learning function or a self-optimizing function which can eventually reduce any deviations from the setpoint profile to those which lie within the acceptable tolerances.

The correction of the weighting factors can be effected continuously or at regular intervals and can be effective for each subsequent rolling operation based upon a preceding rolling operation.

The maintenance of especially narrow tolerances is enabled by ensuring substantially constant tension-compression ratios in the rolled product between successive roll stands. To support this condition advantageously, a data exchange is provided between the control system providing weighted corrected setpoint values for the mill stand and a tension-compression control for the mill stand. The production of weighted corrected values for the setpoint is most effectively accomplished as close as possible in time to the comparison of the setpoint profile with the profile and thus in a kind of on-line control. Thus while a workpiece is in a mill stand, the head thereof which has emerged, can already be measured so that corrected setpoint values can be fed back to the mill stand for adjustment while the balance of the workpiece continues to be rolled thereby. In that case, corrections can be achieved between the rolling of the head of the rolled product and middle and end portions thereof.

The method of the invention has been found to be especially suitable for the operation of a rolling mill train for the production of double-T girders. Such a rolling train has at least one so-called universal mill stand having both a pair of horizontal rolls and a pair of vertical rolls. In this rolling train, preferably the setpoints for the operating parameters of web thickness, plan head and/or flange thickness are controlled with appropriate weighted corrected setpoint values and are maintained with especially narrow tolerances. It is precisely the profile of a double-T girder which has a central web flanked by transverse flanges on either side which admits of rolling under such controlled conditions. The web thickness, flange height and flange thicknesses practically completely define the double-T girder. The adjustment of the web thickness can be achieved by a corresponding adjustment of the rolling gap between the horizontal rolls of the universal stand. The universal stand can be controlled so that a setpoint value is provided for the web thickness and this setpoint value can be used to adjust the stand directly or through derived operating parameters, for example, through position settings of the individual horizontal rolls.

According to a feature of the invention, the respective mill-stand-specific weighting factors are dependent upon the rolled product and material. As a consequence, the contribution of each mill stand to the total deviation of the rolled product from the setpoint product and which is a function both of the characteristics of the mill stand and its role in the rolling process, as well as of the material rolled, will reflect all of these factors and not be exclusively a function of the position of the respective mill stand in the train. The corrected setpoint is applied to the mill stand with or in place of the corresponding original setpoint and will reflect the weighting factor as well.

The horizontal rolls which cooperate in each roll stand to define the web of the rolled product can be adjusted together. It is possible for example to symmetrically and simultaneously adjust the pairs of horizontal rolls each with a single setpoint value, especially a setpoint value controlling the rolling pressure or force. Of course it is possible to adjust each of these rolls independently with respect to an imaginary reference plane midway between them. The horizontal rolls of the separate mill stands can be separately adjustable or, if appropriate, adjusted by common setpoint values appropriately weighted for the respective mill stands. In principle, the rolls can be adjustable independently from one another so that the setpoint inputs to them may reflect absolute values of their positions with respect to a reference plane or a number of reference planes, such as the rolling plane, and absolute values of the rolling gaps. With the system of the invention, however, there is considerable flexibility since the corrected setpoints for the different stands are weighted separately and can be used to adjust individual rolls. The invention, as a consequence, contributes a higher degree of freedom in controlling the various parameters to which the mills respond and enable the greater flexibility to be used to maintain especially narrow tolerances. The compensation for rolling defects with the invention, therefore, is not only possible between the stands but within each individual stand and among the independently adjustable rolls of each individual stand.

To avoid overcompensation of rolling defects in a reliable manner, especially where there is a danger that any modified setpoint application might be excessive from point of view of the acceptable tolerances, each corrected setpoint value is advantageously limited to a parameter specific maximum value. Alternatively or in addition, it has been found to be advantageous to supply a corrected setpoint value for a horizontal adjustment and a corrected setpoint value for a vertical adjustment of a particular roll stand in which the ratio of the corrected setpoint values are limited to a predetermined maximum.

The corrected values can be determined based upon previous rolling processes. For instance, a number of previous rolling results can be evaluated and for each of them the profile of the rolled product can be determined and based upon the difference between the setpoint and actual profiles in each of those cases, by averaging or by some other algorithm, the corrected value can be determined either automatically or with the intervention of a service person. For example a correction can be undertaken when the sum of corrected values or corrections exceed a predetermined limiting value. Of course it is possible to generate the corrected setpoint value directly from a single preceding rolling operation and even on the fly within a single operation as has been noted or to use an immediately preceding rolling operation or the one in progress in a more highly weighted contribution to the correction. The results can be the basis for presetting the rolls for the next rolling operation or a newly introduced workpiece for which there may not yet be an evaluatable actual value of a setpoint or profile. However, it is preferred, whether or not inputs are provided from preceding passes or preceding rolling operations, always to provide a certain portion of the length of the rolled product as a test piece which is compared with the setpoint profile and to utilize a correction in the further rolling of the workpiece.

In the production of double-T girders especially, it has been found to be advantageous to utilize a reversing rolling process in which the workpiece is passed repeatedly through the roll train back and forth so that the movement of the workpiece through the mill stands is a kind of oscillating movement. In a first pass in one direction, a cross section reduction is effected and a cross section reduction is then effected upon movement of the workpiece through the mill stand in the opposite direction. This can be repeated any number of times with adjustment of the mill stand rolls between such passes and before the workpiece is then forwarded onto another group of mill stands or another mill stand, for final rolling therein. In that case, a detection of the profile of the workpiece can be effected at an intermediate stage between, for example, repeated passes of the workpiece through the mill stands and compared with the setpoint profile to generate the corrected setpoint values. This approach has been found to allow very narrow tolerances to be maintained. The settings of the mill roll of each subsequent pass can be determined by the measurement from a previous pass by way of example. The corrected setpoint value thus represents in each case an adaptation of the setting previously provided and is determined by a combination of the original setting and the corrected value.

This type of adaptation is rolling-pass dependent and can also be rolled-product dependent. The adaptation enables an especially rapid reaction or compensation when rolling to defects as they arise. To detect the actual profile of the rolled product after each pass in one direction or the other, on both sides of the plurality of rolling stands which are traversed by the rolled product on each pass, respective measuring devices are provided to detect the contour of the rolled product of that pass. An especially simple construction, however, utilizes a single measuring device or system which can advantageously be provided downstream of the set of roll stands in the original or initial rolling direction, i.e. immediately downstream of the last of the plurality of rolled stands which are traversed by the workpiece. In such a configuration of the apparatus, the adaptation can be effected after a "pass x", i.e. the evaluation of the actual rolled product profile can be effected after each $x^{th}$ pass through the respective rolling mill or group of mill stands and thus for pass x, pass x+2 and thereafter every further second pass. In the passage in the opposite direction, i.e. the x+1 pass, to minimize any effect of error and without requiring a measurement to the workpiece upon the completion of that pass, we operate by interpolation between the previous corrected value and an expected or probably value for the next x+2 pass to determine a probably value for the intervening x+1 pass.

The control system for the rolling train of the invention can comprise a controller which is usually a computer which can be programmed as to the setpoint value which is expected after each pass or each x+2 pass, as discussed, or is provided with a memory bank containing the setpoint profile data. The computer is connected to the measuring device or devices which detect the actual profile or characteristics of the actual profile which can be compared with the setpoint value described. The memory or storage can also include stand-specific weighting factors and these can be tapped from memory based upon the stand through which the workpiece is passing at any given moment.

The corrections can be made on the fly or between passes or after the rolling of a workpiece and before the rolling of the next workpiece.

With the system of the invention, the weighting factor specific to the particular mill stands are used in calculating the corrected setpoint values which enables error compensation where those errors occur or so as to prevent those errors from occurring, thereby precluding accumulation of errors from contribution of the various roll stands in the roll product. The individual roll stands are controlled individually or in groups based upon the calculated corrections with the weighting factors so that practically complete compensation for errors can be ensured and especially narrow tolerances can be maintained. Since the adjustment and determination of the corrected values can be effected automatically, the involvement of service personnel is held to a minimum and the need for sampling of the workpiece can be minimized as well. The occasions on which the mill train must be brought to standstill because tolerances are exceeded can be reduced, if not eliminated entirely and the roll train thus can have an especially high throughput and productivity.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
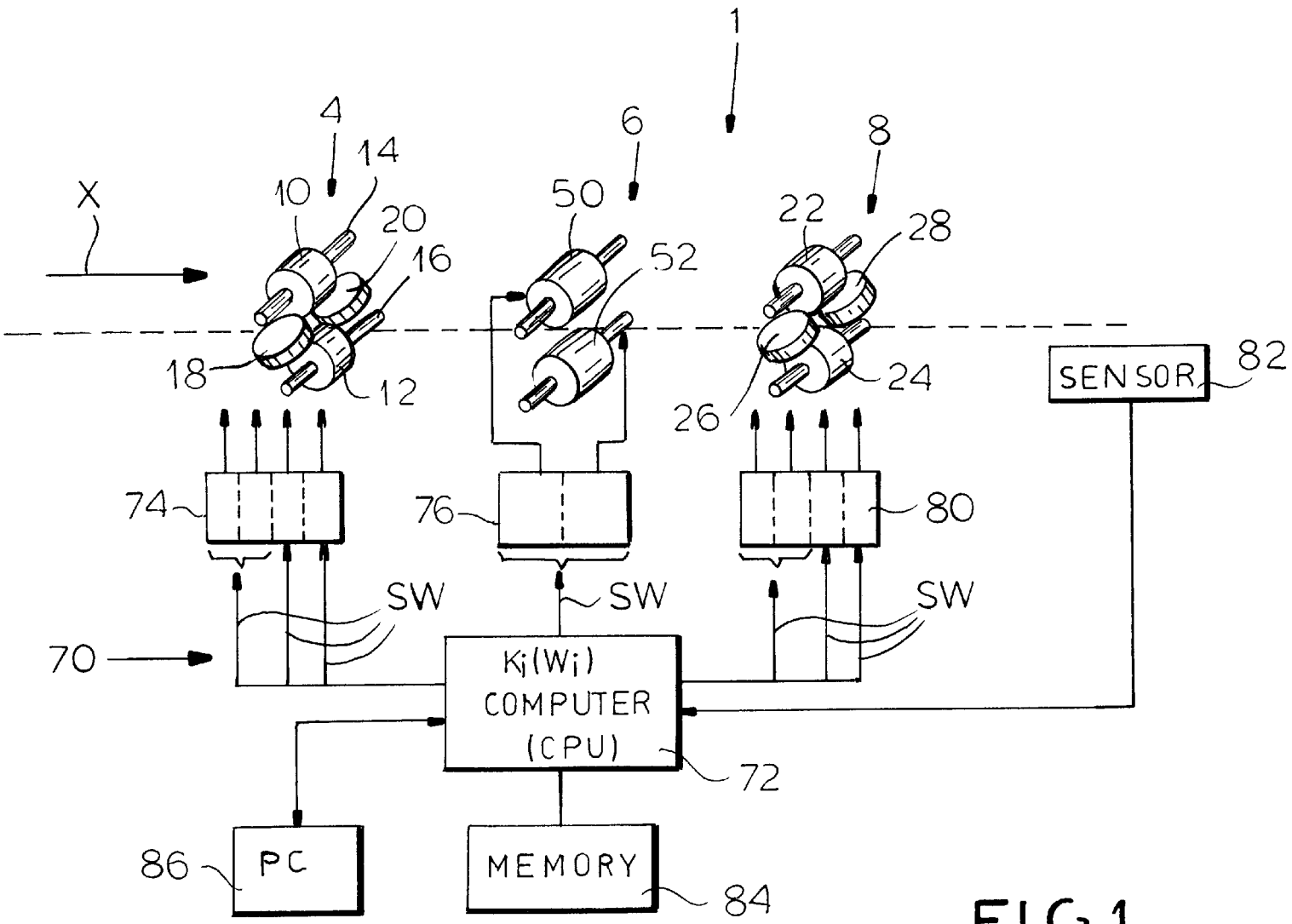
FIG. 1 is a diagram of a multistand rolling train with the associated control system.

FIG. 1 shows a part of a rolling train for producing structural shapes and, especially, structural shapes with webs and flanges, for example double-T girders, I-beams and H-beams. The rolling train 1 comprises a plurality of roll stands which are arranged in the direction x represented by the arrow 2 and referred to here as the rolling direction. These rolling stands are set for staged reduction in the cross section of the workpiece in the usual manner can comprise in example, of a first rolling stand 4, a second rolling stand 6, and a third rolling stand 8 each including respective working rolls as illustrated and effectors which have not been shown except as arrowheads in FIG. 1, for adjusting the parameters of the respective roll stands.

In addition to the roll stands 4, 6 and 8, the rolling train 1 can also include other roll stands which can be provided between those shown or upstream and downstream of those which have been illustrated and for the roll stands illustrated it may be mentioned that the rolling in the direction x can involve a more coarse or preliminary rolling in stand 4 and a finer or finishing rolling in stand 8.

Figure 2:
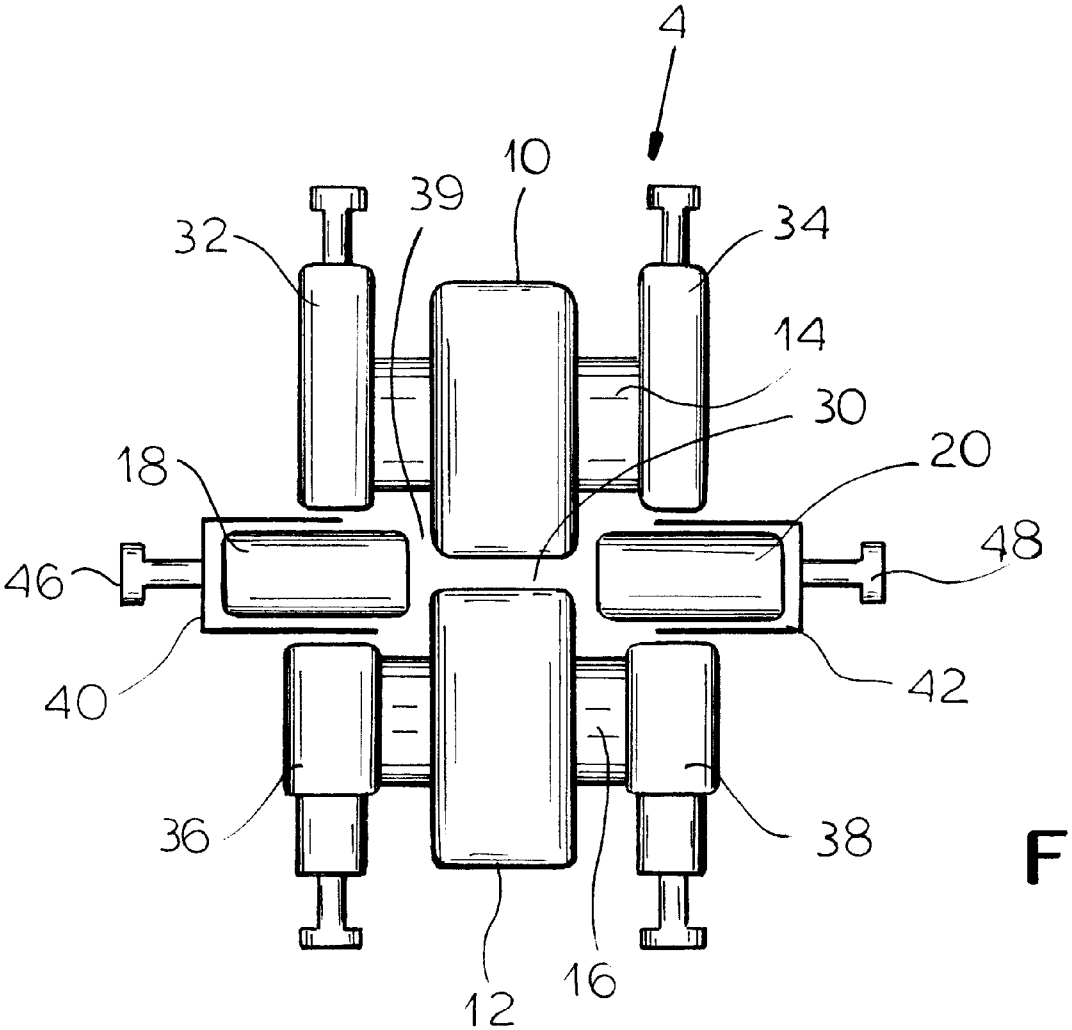
FIG. 2 is a diagram of a universal mill stand as can be used in this system.

The roll stands 4 and 8, in the example illustrated in FIG. 1 are so called universal roll stands (see FIG. 2). In the case of the roll stand 4, for example, there are a pair of horizontal rolls 10, 12, intended to roll the web with a structural shape and disposed in vertical juxtaposition, i.e. one above the other. The horizontal rolls 10 and 12 are rotatably journaled by their respective roll shafts or pins 14, 16 in the bearings of respective frame elements (not shown) of the stand. The first stand 4 also includes a pair of vertical rolls 18, 20, which engage the outer flanks of the structural shape and define the overall width thereof. The vertical rolls form rolling gaps between their rolling surfaces and the end faces of the horizontal rolls 10, 12. Correspondingly, the universal mill stand 8 has a pair of horizontal rolls 22, 24 as well as a pair of vertical rolls 26, 28.

A stand of the universal type has been shown in FIG. 2 and in this Figure the reference characters of the stand 4 have been used. From FIG. 2 it will be apparent that the horizontal rolls 12, 14 define a rolling gap 30 which determines the web thickness of a double-T girder forming the rolled product. The horizontal rolls 10 have their shaft or pins engaged in hydraulically actuatable members 32 and 34 which may be piston and cylinder units not shown in detail and which can press the roll 10 toward the roll 12 to adjust the rolling force as a parameter of this mill stand and/or the gap width 30.

The hydraulic cylinder units 32, 34 have not been illustrated in detail but are mounted on the stand so that, upon being supplied with a hydraulic medium, can serve to adjust the roll position. The supply of the hydraulic medium to the hydraulic cylinder units 32, 34 can be accomplished by appropriate effectors, for example, servovalves, which vary the working medium pressure in the hydraulic cylinder units 32, 34 in accordance with the setpoint values or corrected setpoint values to be applied. The initial value can establish a setpoint position for the horizontal roll 10 or for a rolling force with which the horizontal roll 10 is to act upon the structural shape. Analogously the second horizontal roll 12 can be mounted via its roll shafts 16 on hydraulic cylinder units 36 and 38.

As can also be seen from FIG. 2, the vertical rolls 18, 20 on opposite sides of the horizontal rolls 10, 12 and between the roll shafts 14, 16, can be mounted for rotation about vertical axes in respective holders 40 and 42 which can be shifted hydraulically to vary the widths of the gaps 39 and the width B of the structural shape. The vertical rolls have hydraulic cylinder units 44 or 46 mounting their holders 40 and 42 on the frame of the mill stand.

Between the first roll stand 4 and the third roll stand 8 in the rolling direction x (FIG. 1), there is provided a second roll stand 6 which, in the illustrated embodiment is a two-roll stand with a pair of horizontal rolls 50, 52 and which are longer than the horizontal rolls 10, 12 and 22, 24 of the first and last mill stands 4 and 8 of the position of the rolling train illustrated. The mill rolls 50 and 52 are vertically adjustable to establish the flange height FH of the structural shape (see FIG. 3).

Figure 3:
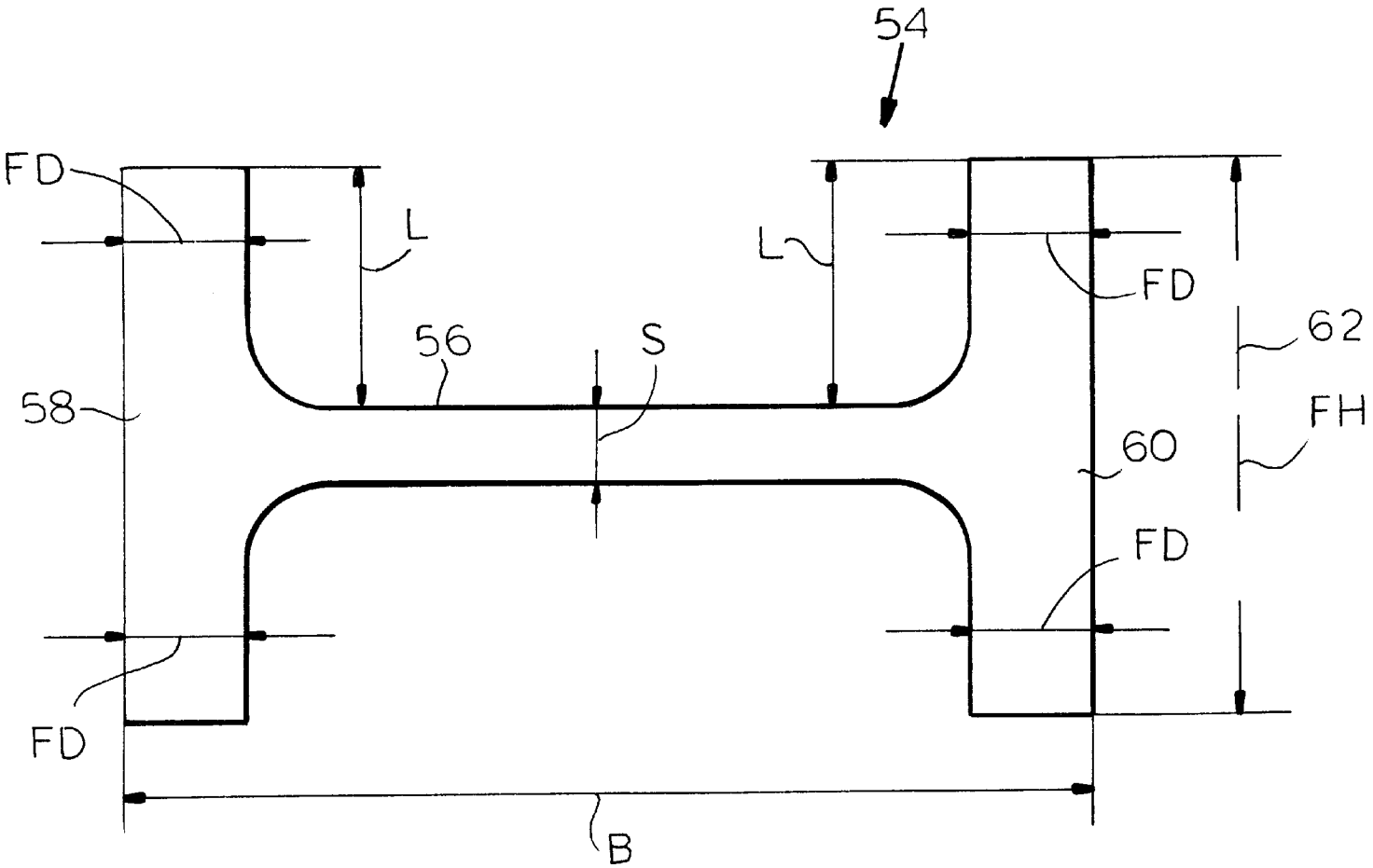
FIG. 3 is a cross section through a double-T girder serving to illustrate the invention.

The portion of the rolling train shown in FIG. 1 shows to produce a double-T girder as shown in FIG. 3 which also illustrates some of the relevant parameters of this structural shape. The profile of the structural shape, i.e. the double-T girder, includes a web 56 forming the central portion of the structural shape and having a web thickness S. On the ends of the web, respective flanges 58 and 60 is characterized by its flange height FH and flange thickness FD. The flange height is represented by the double-headed arrow 62.

To completely describe the structural shape 54, the double-width B is also required as is the position of the flange relative to the web since the flanges may be asymmetrical or symmetrical. The positioning can be determined by the distance L of an edge of the flange from the proximal surface of the web. This distance L has also been shown in FIG. 3.

The profile of the double-T structural shape shown in FIG. 3 is thus determined by the thickness S of the web 56, determined by the rolling gap 30 between the horizontal rolls 10, 12 or 22, 24. The flange height is determined by the gap between the horizontal rolls 50 and 52. The width B is determined by the spacing between the vertical rolls 18 and 20 and the characteristics of the flanges are determined by the gap widths 39. These parameters of the structural shape, as it leads the third rolled stand 8, are measured to determine the profile which is compared with the setpoint profile. For that purpose the control system 70 comprises a central processing unit or computer 72 which is connected with a memory or storage module 84 and has at its output side a number of effectors 74, 76, 78 for the roll stands 4, 6 and 8, respectively, applying appropriate control "signals" or parameters to the mill stand. At its input side, the central processing unit 72 is connected with the sensor or measuring unit 82 which determines the actual profile of the roll product in terms of characteristic values which may be the dimensions or parameters mentioned above. From the memory 84 the CPU 72 reads out the setpoint profile to detect the differences. An input of data also may be provided from a personal computer or other input terminals represented at 86.

The effectors or servocontrollers 74 connected to the first rolling stand 4 receive corrected setpoint values SW from the CPU, weighted as a function of that rolling stand. Analogously, corrected values of the setpoints are applied to the effectors 76 and 80 for the roll positions of the mill stands 6 and 8. The effectors 74, 76 and 80 may all be of modular design and assembled from similar modules selected in number to correspond to the number of elements controlled in the respective stand.

In operation of the rolling train 1, the controlling unit 72 outputs setpoint values SW for the operating parameters of the roll stands 4, 6 and 8 to the respective effectors 74, 78 and 80. The control unit 72 is configured to output values which define the characteristic parameters for the structural shape 54 to be produced. In the example shown those parameters are, for instance, the positions of the horizontal rolls 10, 12 with reference to the rolling plane and thus for a substantially symmetrical adjustment of the rolling gap 30. The horizontal rolls 10, 12 thus respond to respective but associated setpoint values SW for the rolling gap 30 and this has been illustrated as utilizing the first two modules of the effector group 74 shown in FIG. 2. Alternatively, the horizontal rolls 10, 12 can be supplied with setpoint values which are independent from one another. A single setpoint value can be supplied for control of the gap 30 and further setpoint values SW for each of the vertical rolls 18, 20 as desired.

The effectors 74 thus function as subordinate control elements in the control hierarchy to convert the particular setpoint SW delivered by the computer 72 into the control action or the particular operating parameter, e.g. the rolling gap 30, corresponding to the web thickness S of the double-beam girder, or into a rolling force which, in an equivalent manner, will result in the rolling of the workpiece to this web thickness. The setpoints can be converted, if desired, into particular control signals for this purpose, e.g. the pressure of the hydraulic medium delivered to the hydraulic cylinders 32, 34, 36, 38 or some other "signal" capable of achieving the modification of the operating parameter in the manner described. In an analogous way the computer 72 supplies setpoint values SW for the rolling gap of the horizontal rolls 22, 24 and the vertical rolls 26, 28 of the third rolling stand 8 and the effectors 80 thereof. At the effectors 76, the computer 72 delivers setpoint values SW for the vertical positioning of the respective horizontal rolls 50, 52. In the effectors 76 there can be a conversion of the supplied setpoints SW to the respective signals for controlling the operating parameters and especially the pressures of the associated hydraulic cylinders. So that, from a time point of view, the feedback to the roll stands based upon the detection of a difference between a setpoint configuration and the actual rolled configuration will be a minimum and thus tolerance values will be closely maintained, the measuring device 82 is provided so that it is close to the last roll stand of the sequence and the control signals are generated by the computer 72 in an online basis. The actual value is the result of a measurement and the setpoint value of the configuration can be derived from memory or from tabulated values corresponding to the configuration of the setpoint profile. In fact, the on-line correction may be effected while a portion of the rolled article is still within the rolling train. The correction can utilize the two-value setting in which case one value delivered to the effectors is a presetting value while the second value is a correction of the presetting value.

During the correction, the parameters of the roll stands 4, 6 and 8 can be effected independently of one another and the error, if any, detected by the measuring device 82, can be a cumulative error. However any correction of the error, the corrected setpoints applied to each of the groups of effectors can not only have the requested correction distributed among the stands but weighted by the aforementioned weighting factors based upon the response to the stand to the corrected setpoint and the effect of the particular stands. In the illustrated case, the correction $K_i$ distributed among the stands forms a product with the weighting factor $W_i$ for the $i^{th}$ stand. A global error can be determined by the sensor 82 and the computer 72 and the latter can break up the correction based upon a distribution property among the stands for the correction factors $K_i$ and form respective products with the weighting factors $W_i$. The correction factors and weighting factors may vary depending upon the nature of the rolled product and the composition or type of product made. In other words for each rolled product type and composition, a separate and individual set of mill-stand-specific weighting factors $W_i$ can be provided in the memory 84 for each of the mill stands 4, 6, 8. The weighting factors themselves can be modified based upon the results obtained from each preceding rolling so that they are altered for each succeeding rolling by a learning factor.

The individual rolls can be independently adjusted for each of the roll pairs and for each of the mill stands by the roll-specific weighting factors. The weighting factors therefore can be provided for each roll within the individual stands as well. The weighting factors can be provided in the computer 72 to itself, can be derived partly from a separate memory 84 or from storage within the computer, or can be provided at the level of the effectors 74, 76, 80.

As has been noted previously, the rolling line illustrated can be operated unidirectionally or in a reversing rolling operation. With a reversing rolling operation each workpiece traverses the mill stands 4, 6 and 8 first in one direction and then in the opposite direction, each pass in one or the other directions requiring an adjustment of the respective stand so that a cross sectional reduction will occur in each stand with each pass.

The detection of the profile can be effected with a single sensor 82, however, and the computer 72 can interpolate the correction values between passes in which the measurements are made.

We claim:

1. A method of operating a rolling mill train for producing structural shapes, comprising the steps of:

(a) rolling a workpiece in a succession of mill stands, each equipped with a plurality of working rolls engaging said workpiece to reduce a cross section thereof in a configuration of a structural shape to be produced, each of said mill stands having a plurality of adjustable operating parameters determining the rolling process in the respective mill stand;

(b) detecting a profile of a structural shape produced by said succession of mill stands and comparing the detected profile with a set-point profile corresponding to a structural shape to be produced;

(c) deriving from the comparison of the detected profile with the setpoint profile respective corrective setpoint values for each of said parameters determined by deviation of the detected profile from the setpoint profile;

(d) weighting each of said corrective setpoint values with a weighting factor specific to the respective mill stand to produce weighted corrected setpoint values for each of said parameters; and (e) adjusting the operating parameters of each of said mill stands with the respective weighted corrected setpoint values.

2. The method defined in claim 1 wherein the corrected setpoint values for at least one of said mill stands include a setpoint value for at least one structural shape dimensional parameters selected from a web thickness, a flange height and a flange thickness.

3. The method defined in claim 2 wherein the corrected setpoint values for each of said mill stands include setpoint values for each of said structural shape dimensional parameters.

4. The method defined in claim 1 wherein the respective mill-stand-specific weighting factors are rolled-product dependent.

5. The method defined in claim 1 wherein each of said mill stands is controlled individually by respective determinations of deviations of detected profiles from setpoint profiles for the respective mill stands, derivation of respective corrected setpoint values, weighting of the corrective setpoint values with respective mill-stand-specific weighting factors, and adjustment of the operating parameters of each individual mill stand with the respective weighted corrected setpoint values.

6. The method defined in claim 1 wherein said corrected setpoint values are limited by parameter-specific maximum values.

7. The method defined in claim 1 wherein the weighted corrected setpoint values are generated in a preceding rolling operation.

8. The method defined in claim 1 wherein said workpiece is rolled in multiple passes through said train and the mill stands are adjusted in each subsequent pass in response to the respective weighted corrected setpoint values obtained in a previous pass.

9. The method defined in claim 1 wherein a corrected setpoint value is obtained for a horizontal position of a mill stand and another corrected setpoint value is obtained for a vertical position of the mill stand, said method further comprising the step of limiting a ratio of the corrected setpoint values for said horizontal and vertical positions to a predetermined maximum value.

10. A rolling mill train comprising:

a succession of mill stands, each equipped with a plurality of working rolls engaging a workpiece to be rolled in said stands to reduce a cross section thereof in a configuration of a structural shape to be produced, each of said mill stands having a plurality of adjustable operating parameters determining the rolling process in the respective mill stand;

at least one sensor for detecting a profile of a structural shape produced by said succession of mill stands and comparing the detected profile with a set-point profile corresponding to a structural shape to be produced;

means for deriving from the comparison of the detected profile with the setpoint profile respective corrected setpoint values for each of said parameters determined by deviation of the detected profile from the setpoint profile and for weighting each of said corrected setpoint values with a weighting factor specific to the respective mill stand to produce weighted corrected setpoint values for each of said parameters; and means for adjusting the operating parameters of each of said mill stands with the respective weighted corrected setpoint values.

11. The rolling mill train defined in claim 10 further comprising a storage module connected to a computer for storing mill-stand specific weighting factors.

12. A control system for a mill train for rolling a workpiece in a succession of mill stands, each equipped with a plurality of working rolls engaging said workpiece to reduce a cross section thereof in a configuration of a structural shape to be produced, each of said mill stands having a plurality of adjustable operating parameters determining the rolling process in the respective mill stand, said control system comprising at least one sensor for detecting a profile of a structural shape produced by said succession of mill stands and comparing the detected profile with a set-point profile corresponding to a structural shape to be produced, a computer connected to said sensor, a computer connected to said sensor for comparing the detected profile with the setpoint profile and deriving respective corrected setpoint values for each of said parameters determined by deviation of the detected profile from the setpoint profile, means for weighting each of said corrected setpoint values with a weighting factor specific to the respective mill stand to produce weighted corrected setpoint values for each of said parameters, and means for adjusting the operating parameters of each of said mill stands with the respective weighted corrected setpoint values.

* * * * *